United States Patent [19]

Kopp

[11] 4,111,642

[45] Sep. 5, 1978

[54] BURNER FOR LIQUID FUELS

[75] Inventor: Hermann Kopp, Schwendi, Wuerttemberg, Germany

[73] Assignee: Max Weishaupt GmbH, Germany

[21] Appl. No.: 746,155

[22] Filed: Nov. 30, 1976

[30] Foreign Application Priority Data

Dec. 1, 1975 [DE] Fed. Rep. of Germany ..... 2553953

[51] Int. Cl.[2] ..... F23D 13/12

[52] U.S. Cl. ..... 431/347; 239/504

[58] Field of Search ..... 431/265, 347, 184, 350; 239/504, 524

[56] References Cited

U.S. PATENT DOCUMENTS

| | | | |
|---|---|---|---|
| 2,242,787 | 5/1941 | Lieberherr | 431/184 |
| 2,320,576 | 6/1943 | Dunn | 431/184 X |
| 3,212,556 | 10/1965 | Johansson | 431/265 |
| 3,223,141 | 12/1965 | Safford | 431/265 |
| 3,385,527 | 5/1968 | Drewry | 431/265 X |
| 3,799,732 | 3/1974 | Brodlin | 431/347 |

FOREIGN PATENT DOCUMENTS

| | | | |
|---|---|---|---|
| 1,288,225 | 2/1962 | France | 431/184 |

*Primary Examiner*—Edward G. Favors

*Attorney, Agent, or Firm*—Craig & Antonelli

[57] ABSTRACT

A burner for liquid fuels, of the type which is driven with an approximately stoichiometric quantity of air, having switchover means associated with an air feed pipe for causing the combustion air to be set into turburlence during starting but allowing the combustion air to flow without turbulence during continuous operation.

39 Claims, 4 Drawing Figures

BURNER FOR LIQUID FUELS

BACKGROUND OF THE INVENTION

The present invention relates to a burner for liquid fuels of the type which is driven with an approximately stoichiometric quantity of air, having a fuel feed pipe with a spray nozzle disposed concentrically in an air feed pipe; a terminal cone tapering in the direction of flow at the end of the air feed pipe in the plane of whose mouth the outlet opening of the said spray nozzle is located; and a hollow mixture-distributor body that is axially adjustable at a distance from the spray nozzle, said distributor having perforations and a convex surface opposite the spray jet. With this type of burner, the outlet cross section of the terminal cone of the air feed pipe is smaller than the cross section of the area of the mixture-distributor body as determined by the peripheral contour, and is so dimensioned that the issuing air forms a mixture with the fuel at a flow velocity that is greater than the velocity of flame propagation. As a result, the mixture-distributor is provided in the forward zone turned toward the spray nozzle by a tubular hollow body that functions as a shield which prevents an axial inflow of the fuel-air mixture. The shield is disposed near the mixture-distributor body, between the body and the spray nozzle, forming openings with the shield within which the parts that serve to enlarge the surface are disposed. Such a type of burner is known as shown by German Gebrauchsmuster No. 7,424,420.

The conventional mixture-distributor body causes much more rapid glowing than heretofore, but without harm to the igniting process so that immediately upon conclusion of the igniting process there is a steady blue flame which is absolutely free of soot or odor, with high $CO_2$ values, and CO values far below the permissible CO value of 0.1% by volume in the waste gas.

Moreover, known burners also regulate combustion air by means of a drum slide and adjustable swirl vanes. Inner and outer air nozzles are disposed concentrically about the spray nozzle, whereby a swirl body is supplied between the fuel feed line and the inner air nozzle. At half load, the outer air nozzle is closed and air is supplied only via the swirl body. At three-quarter load and full load, combustion air is supplied by both inner and outer air nozzles, i.e. at all load ranges combustion air flows through the swirl body, which acts over the whole load range as the flame holder. It is thereby possible, in all load stages of such yellow burners, to have maximum combustion. In that type of burner there is no mixture-distributor body as in the present invention.

SUMMARY OF THE INVENTION

The present invention is addressed to the problem of developing a burner of the above-mentioned type in such a way that the heating up of the mixture-distributor body during the start-up process will be accelerated without changing the behavior of the burner during its subsequent continuous operation.

In an older form of burner which does not belong to the known state of the art of this type burner, however, the free end of the hollow body disposed inside the mixture-distributor is surrounded concentrically at an equal distance all around by a ring that is about L-shaped in cross section and that is rigidly connected by cross-pieces with the middle zone of the mixture-distributor body. The present invention also makes use of these means, but is further characterized in that on the side of the air feed there is a switchover device that is adjustable in such a way that the combustion air is swirled in the zone of the spray nozzle during start-up, and flows without turbulence during continuous operation which sets in after the heating up of the mixture-distributor body.

The starting point of the present invention is the recognition that the start-up of ordinary commercial burners that function as yellow burners causes no problem, whereas the start-up of the burner of the type in question, i.e. a blue burner, presents difficulties now and then. The basic idea of the present invention therefore consists in starting up the so-called blue burner as though it were a so-called yellow burner and then, when the mixture-distributor body has become sufficiently heated, allowing the blue burner to continue to operate in its usual way. Thus the problem to which the present invention is addressed is advantageously solved, since the start-up of the so-called blue burner now presents no difficulty. This is a substantial advance over prior burners even though movable parts have to be associated with the known blue burners. On the other hand, the annular body that previously served as auxiliary ignition means as shown, for example, in the above-referred-to German Gebrauchsmuster No.. 7,424,420 in the region of the mouth of the air feed pipe can now be dispensed with.

The switchover device may consist of a swirl element slidably disposed in the air feed pipe behind the inlet of its terminal cone and surrounding the fuel feed pipe so as to be slidable between two end positions. One position of the switchover device corresponds to the start-up setting of the burner to swirl the combustion air, and the other position of the device corresponds to continuous operation allowing the combustion air to flow through the air feed pipe without turbulence. However, it is possible to surround the air feed pipe with another air feed pipe and to dispose in the mouth zone of the inner air feed pipe at its outer periphery a barrier made as a swirl element, and to configure the switchover device as a shield that can be adjusted in such a way that during the start-up process only air flows between the two air feed pipes, and during continuous operation air flows only through the inner feed pipe. In order to be able easily to insert the burner in a vessel, it has been found preferable that in the latter arrangement the outer air feed pipe can have a tapered constriction and a terminal cone so that the holder that supports the mixture distributor is inside the imaginary extension of the cylindrical part of the air feed pipe with maximum diameter.

BRIEF DESCRIPTION OF THE DRAWING

These and further features, objects and advantages will become apparent from the following detailed description when taken in conjunction with the accompanying drawings which show several preferred embodiments of the present invention and wherein:

FIG. 2 shows a longitudinal section through a flame head of a spray oil burner with a mixture-distributor body, wherein two air feed pipes are provided and the switchover device consists of a shield or the like;

DETAILED DESCRIPTION OF PREFERRED EMBODIMENTS

Figure 1:
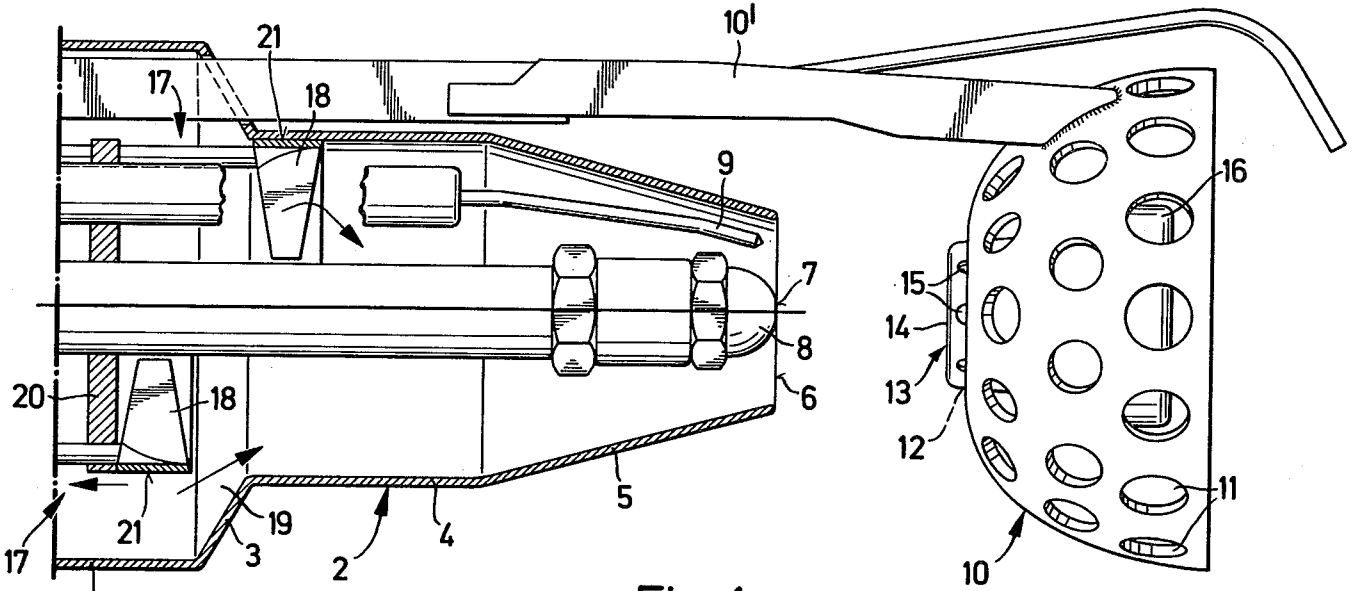
FIG. 1 shows a longitudinal section through a flame head of a spray oil burner with which a mixture-distributor body is associated and which has a switchover device with a movable swirl element in accordance with the present invention.

Referring now to the drawing and, in particular, to FIG. 1, the cylindrical portion 1 of an air feed pipe 2 makes a transition via a hollow cone 3 into a cylindrical portion 4 of smaller diameter. A conical convergent terminal cone 5, which is made in a known way as an air-dispensing nozzle is connected to cylindrical portion 4. The diameter of mouth 6 of terminal cone 5 is a fraction of the air intake diameter of air feed pipe 2, so that air from terminal cone 5 issues as a straight air jet with relatively high velocity. Mouth 7 of spray nozzle 8 which is coaxially disposed with reference to terminal cone 5 is in the plane of the mouth 6 of the terminal cone 5. Two electrodes 9 are provided, only one of which is visible. A mixture-distributor body 10 is adjusted to be located at a certain distance from the burner on air feed pipe 2 via a holder 10′ or the like. The mixture-distributor 10 has holes or perforations 11, is made as a hollow sphere, and has a convex configuration.

Figure 3:
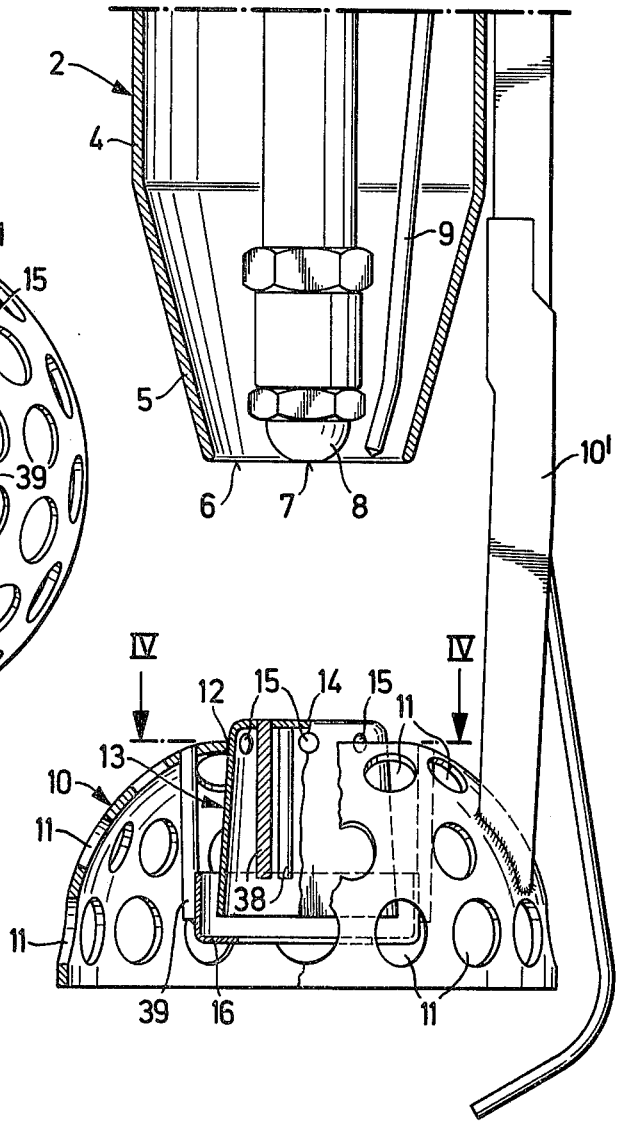
FIG. 3 shows a cross section through the air feed pipe and the mixture-distributor of the above-mentioned older solution, which has not been published before.
Figure 4:
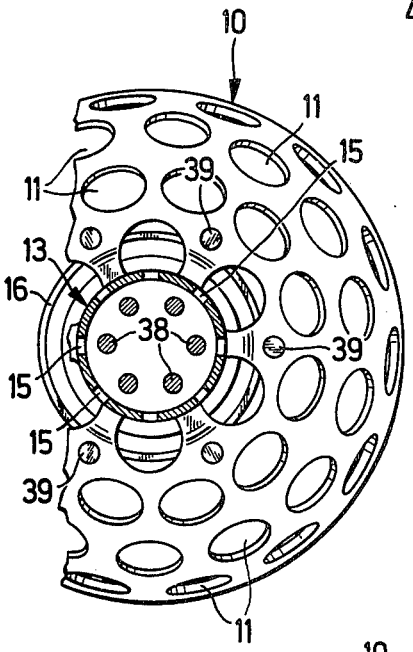
FIG. 4 is a sectional view taken along line IV—IV of FIG. 3.

In its forward zone that is turned toward spray nozzle 8, mixture-distributor 10 is provided with an opening 12 through which a hollow body 13 extends. The body 13 can be made as one piece with a floor or base 14 that serves as a cover. The axial length of this hollow body 13 is less than the depth of the mixture-distributor. Immediately behind the floor 14 in the downstream direction, apertures 15 are provided in the jacket surface of the hollow body 13, in the zone where the hollow body extends through mixture-distributor 10 and run crosswise or transverse to the nearby openings 11 of the latter as shown in FIGS. 3 and 4.

In the cavity of this hollow body 13 parts made, for example, as pins can be disposed to enlarge the surface. Such an arrangement is known and in FIGS. 3 and 4, the pins are designated by numeral 38. However, other parts could also be utilized. The free end of the cup-like hollow body 13 disposed inside the mixture-distributor body 10 is concentrically and equidistantly surrounded by a ring 16 that has a generally L-shaped cross section and is rigidly connected via crosspieces 39 with the mid-zone of the mixture-distributor 10.

In accordance with the present invention, a switchover device 17 is provided in air feed pipe 2. The switchover device 17 supports a swirl body 18 whose position in the upper part of FIG. 1 corresponds to the startup process, and whose position in the lower part corresponds to continuous burner operation. In the start-up process swirl element 18 is disposed inside hollow cylindrical portion 4, and the burner acts, after igniting, like a yellow burner. After sufficient heating of the mixture-distributor 10, swirl element 18 is retracted from hollow cylindrical portion 4 by the switchover device 17 so that the supplied combustion air is now no longer caused to be turbulent but rather flows through annular gap 19 directly through the terminal cone 5. Turbulence cannot occur because the swirl element 18 is applied during the continuous burner operation against a transverse plate 20. Thus, jacket surface 21 of the swirl element 18 acts as part of the air conduit.

Figure 2:
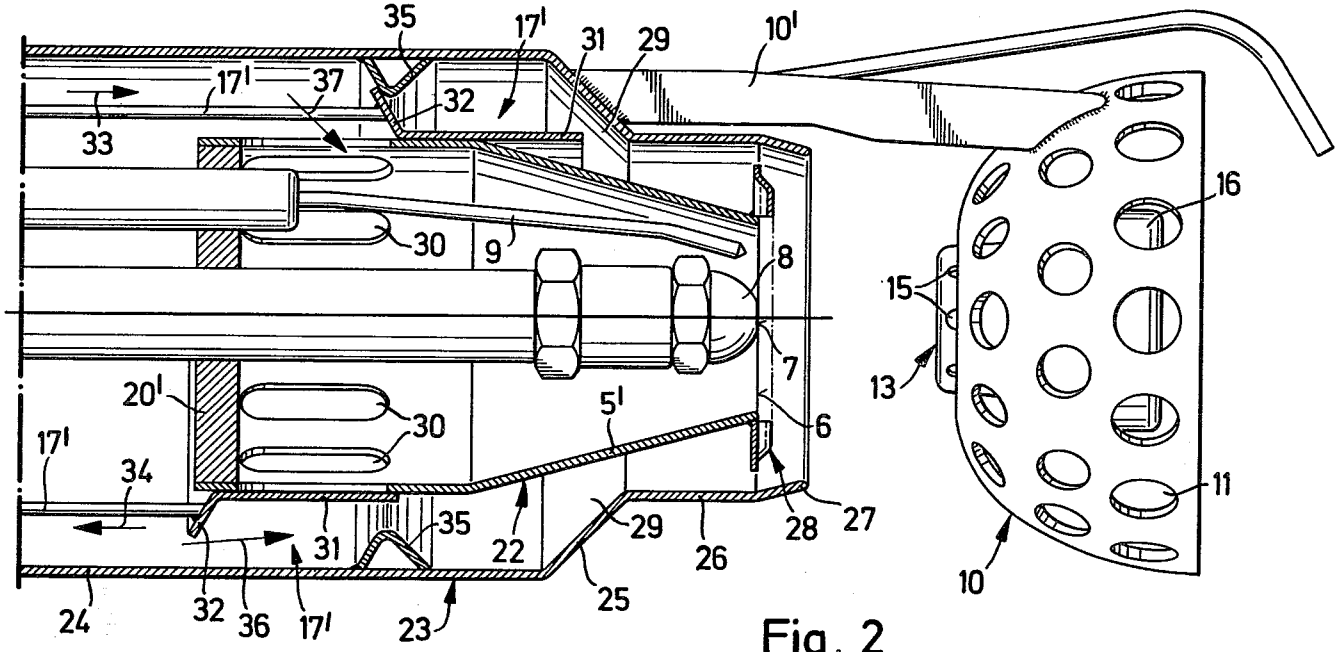

Mixture-distributor 10 of the embodiment of FIG. 2 corresponds to the mixture-distributor of FIG. 1. The air feed pipe 22, provided with terminal cone 5′, is here surrounded by another air feed pipe 23 comprising a hollow cylindrical portion 24, a tapered conical transition portion 25, another hollow cylindrical portion 26, and a downstream tapered terminal cone 27. In the mouth region of the inner air feed pipe terminal cone 5′, there is disposed on the periphery thereof an obstructing body 28, constructed as a swirl element which, as in the case of known baffle plates, presents in addition to a central opening, scoop-like radial slits, so that it sets the air guided between the two air feed pipes 22 and 23 in annular passage 29 into such turbulence in the region of mouth 7 of spray nozzle 8 that the fuel-air mixture burns with a yellow flame. This state corresponds to the position of the individual parts that is illustrated in the lower part of FIG. 2.

Since inner air feed pipe 22 presents longitudinal slits 30 behind a transverse plate 20′, switchover device 17′ in this embodiment consists of a tubular piece 31 that forms a shield with intake funnel 32. These two elements are made in one piece, and can be moved back and forth in the direction of arrows 33 and 34 respective, whereby funnel 32 cooperates with a neck 35 provided on the inner surface of hollow cylindrical portion 24.

If the burner of FIG. 2 is to be started up, switchover device 17′ is moved in the direction of arrow 34, and tubular member 31 acting as a shield closes long slits 30 so that the combustion air can be guided in the direction of arrow 36 between the two air feed pipes 22 and 23. When the mixture-distributor 10 is sufficiently heated, switchover device 17′ will be shifted in the direction of arrow 33 coaxially to the burner feed pipe, and then funnel 32 of tubular piece 31 will abut neck 35, thereby blocking off annular passage 29 so that the combustion air will now be guided in the direction of arrow 37 via air feed pipe 22. Immediately thereafter the flame, which previously burned yellow, will burn blue.

While I have shown and described two preferred embodiments in accordance with my invention, one of ordinary skill will appreciate that modifications and changes may be made without departing from the spirit of my invention. I therefore do not wish to be limited by the appended claims and intend that all such changes and modifications come within the scope of the present invention.

I claim:

1. A burner for liquid fuels, of the type which is driven with an approximately stoichiometric quantity of air, having an air feed pipe, a fuel feed pipe with a spray nozzle disposed concentrically in the air feed pipe, and a mixture-distributor body arranged at a distance from the spray nozzle, wherein the improvement comprises switchover means associated with the air feed pipe for causing, in one position thereof, the combustion air to be in turbulence in the region of the spray nozzle during start-up, during which there is a yellow flame, and, for allowing, in another position thereof, the combustion air to flow without turbulence during continuous operation after the mixture-distributor body has been heated, during which there is a blue flame.

2. A burner according to claim 1, wherein the air feed pipe is provided with a terminal cone portion tapering in the flow direction.

3. A burner according to claim 2, wherein the spray nozzle is located at the end of the air feed pipe such that the outlet opening of the spray nozzle is located in the plane of the mouth of the terminal cone portion.

4. A burner according to claim 1, wherein the mixture-distributor body is hollow and provided with a convex surface opposite the spray nozzle.

5. A burner according to claim 4, wherein the mixture-distributor body is provided with perforations and is axially adjustable so that its distance from the spray nozzle can be selectively varied.

6. A burner according to claim 5, wherein the air feed pipe is provided with a terminal cone portion tapering in the flow direction.

7. A burner according to claim 6, wherein the spray nozzle is located at the end of the air feed pipe such that the outlet opening of the spray nozzle is located in the plane of the mouth of the terminal cone portion.

8. A burner according to claim 2, wherein the mouth cross section of the terminal cone portion of the air feed pipe is smaller than the cross section of the area of the mixture-distributor body as determined by the peripheral contour.

9. A burner according to claim 8, wherein the spray nozzle is located at the end of the air feed pipe such that the outlet opening of the spray nozzle is located in the plane of the mouth of the terminal cone portion.

10. A burner according to claim 9, wherein the mixture-distributor body is hollow and provided with a convex surface opposite the spray nozzle.

11. A burner according to claim 10, wherein the mixture-distributor body is provided with perforations and is axially adjustable so that its distance from the spray nozzle can be selectively varied.

12. A burner according to claim 11, wherein the mouth cross section of the terminal cone portion is so dimensioned that the air issuing from the air feed pipe forms a mixture with the fuel at a flow velocity that is higher than the velocity of flame propagation.

13. A burner for liquid fuels, of the type which is driven with an approximately stoichiometric quantity of air, having an air feed pipe, a fuel pipe with a spray nozzle disposed concentrically in the air feed pipe, and a mixture-distributor body arranged at a distance from the spray nozzle, wherein the improvement comprises switchover means associated with the air feed pipe for causing, in one position thereof, the combustion air to be in turbulence in the region of the spray nozzle during start-up and, in another position thereof, allowing the combustion air to flow without turbulence during continuous operation after the mixture-distributor body has been heated, and wherein the mixture-distributor body is provided in its region opposite the spray nozzle with a tubular hollow body acting as a shield to prevent axial inflow of fuel-air mixture.

14. A burner according to claim 13, wherein the mixture-distributor body is hollow and provided with a convex surface opposite the spray nozzle.

15. A burner according to claim 14, wherein the mixture-distributor body is provided with perforations and is axially adjustable so that its distance from the spray nozzle can be selectively varied.

16. A burner according to claim 15, wherein the air feed pipe is provided with a terminal cone portion tapering in the flow direction.

17. A burner according to claim 16, wherein the spray nozzle is located at the end of the air feed pipe such that the outlet opening of the spray nozzle is located in the plane of the mouth of the terminal cone portion.

18. A burner according to claim 17, wherein the mouth cross section of the terminal cone portion of the air feed pipe is smaller than the cross section of the area of the mixture-distributor body as determined by the peripheral contour.

19. A burner according to claim 18, wherein the mouth cross section of the terminal cone portion is so dimensioned that the air issuing from the air feed pipe forms a mixture with the fuel at a flow velocity that is higher than the velocity of flame propagation.

20. A burner according to claim 19, wherein the shield is disposed between the mixture-distributor body and the spray nozzle and is provided with apertures, means within the shield for enlarging the surface area thereof, a substantially L-shaped, in cross section, ring concentrically surrounding the free end of the shield within the mixture-distributor body, and cross-piece means for connecting the ring with the mixture-distributor body.

21. A burner according to claim 1, wherein the switchover means includes in the air feed pipe a swirl element surrounding the fuel feed pipe and being movable between the two positions corresponding to burner start-up and continuous operation.

22. A burner according to claim 21, wherein the air feed pipe is provided with a terminal cone portion tapering in the flow direction.

23. A burner according to claim 22, wherein the spray nozzle is located at the end of the air feed pipe such that the outlet opening of the spray nozzle is located in the plane of the mouth of the terminal cone portion.

24. A burner according to claim 23, wherein the mixture-distributor body is hollow and provided with a convex surface opposite the spray nozzle.

25. A burner according to claim 24, wherein the mixture-distributor body is provided with perforations and is axially adjustable so that its distance from the spray nozzle can be selectively varied.

26. A burner according to claim 25, wherein the mixture-distributor body is provided in its region opposite the spray nozzle with a tubular hollow body acting as a shield to prevent axial inflow of fuel-air mixture.

27. A burner according to claim 26, wherein the shield is disposed between the mixture-distributor body and the spray nozzle and is provided with apertures, means within the shield for enlarging the surface area thereof, a substantially L-shaped, in cross section, ring concentrically surrounding the free end of the shield within the mixture-distributor body, and cross-piece means for connecting the ring with the mixture-distributor body.

28. A burner according to claim 1, wherein the air feed pipe is surrounded by a second air feed pipe and a swirl element is provided on the outer periphery of the first-mentioned air feed pipe between the first and second air feed pipes in the mouth region thereof.

29. A burner according to claim 28, wherein the switchover means comprises an adjustable member so that in the position during start-up air flows only between the first and second air feed pipes and in the other position during continuous operation air flows only through the first air feed pipe.

30. A burner according to claim 29, wherein the second air feed pipe is provided with a conical transition portion and a terminal cone portion tapering in the flow direction with means for holding the mixture-distributor body being arranged at the conical transition portion.

31. A burner according to claim 30, wherein the air feed pipe is provided with a terminal cone portion tapering in the flow direction.

32. A burner according to claim 31, wherein the spray nozzle is located at the end of the air feed pipe such that the outlet opening of the spray nozzle is located in the plane of the mouth of the terminal cone portion.

33. A burner according to claim 32, wherein the mixture-distributor body is hollow and provided with a convex surface opposite the spray nozzle.

34. A burner according to claim 33, wherein the mixture-distributor body is provided with perforations and is axially adjustable so that its distance from the spray nozzle can be selectively varied.

35. A burner according to claim 34, wherein the mouth cross section of the terminal cone portion of the air pipe is smaller than the cross section of the area of the mixture-distributor body as determined by the peripheral contour.

36. A burner according to claim 35, wherein the mouth cross section of the terminal cone portion is so dimensioned that the air issuing from the air feed pipe forms a mixture with the fuel at a flow velocity that is higher than the velocity of flame propagation.

37. A burner according to claim 36, wherein the mixture-distributor body is provided in its region opposite the spray nozzle with a tubular hollow body acting as a shield to prevent axial inflow of fuel-air mixture.

38. A burner according to claim 37, wherein the shield is disposed between the mixture-distributor body and the spray nozzle and is provided with apertures, means within the shield for enlarging the surface area thereof, a substantially L-shaped, in cross section, ring concentrically surrounding the free end of the shield within the mixture distributor body, and cross-piece means for connecting the ring with the mixture-distributor body.

39. A burner for liquid fuels, of the type which is driven with an approximately stoichiometric quantity of air, having an air feed pipe provided with a terminal cone portion tapering in the flow direction, the mouth cross section of the terminal cone portion of the air feed pipe is smaller than the cross section of the area of the mixture-distributor body as determined by the peripheral contour and is so dimensioned that the air issuing from the air feed pipe forms a mixture with the fuel at a flow velocity that is higher than the velocity of flame propagation, a fuel feed pipe with a spray nozzle disposed concentrically in the air feed pipe, the spray nozzle being located at the end of the air feed pipe such that the outlet opening of the spray nozzle is located in the plane of the mouth of the terminal cone portion, and a mixture-distributor body arranged at a distance from the spray nozzle, this mixture-distributor body being hollow and provided with a convex surface opposite the spray nozzle and with borings, wherein the improvement comprises switchover means associated with the air feed pipe for causing, in one position thereof, the combustion air to be in turbulence in the region of the spray nozzle during start-up, during which there is a yellow flame, and in another position thereof, allowing the combustion air to flow without turbulence during continuous operation after the mixture-distributor body has been heated, whereby the flame is blue.

* * * * *